US005852910A

United States Patent [19]

Zebedee

[11] Patent Number: 5,852,910

[45] Date of Patent: Dec. 29, 1998

[54] RAISED PANEL DOOR

[75] Inventor: Roger Zebedee, Bordon, England

[73] Assignee: Jeld-Wen, Inc., Klamath Falls, Oreg.

[21] Appl. No.: 742,138

[22] Filed: Oct. 31, 1996

[30] Foreign Application Priority Data

Jan. 11, 1995 [GB] United Kingdom ..... 9522354

[51] Int. Cl.[6] ..... A47B 13/08

[52] U.S. Cl. ..... 52/784.1; 52/455; 52/456

[58] Field of Search ..... 52/208, 204.53, 52/204.591, 204.597, 204.62, 314, 316, 784.1, 784.13, 784.15, 455–458, 741.1, 742.1, 742.12, 745.19

[56] References Cited

U.S. PATENT DOCUMENTS

| | | | |
|---|---|---|---|
| 3,760,543 | 9/1973 | McAllister | 52/455 X |
| 3,903,669 | 9/1975 | Pease et al. | 52/455 |
| 4,920,718 | 5/1990 | Artwick et al. | 52/204.591 X |
| 4,947,597 | 8/1990 | Simpson | 52/204.591 X |
| 5,018,330 | 5/1991 | Lewkowitz | 52/455 |
| 5,022,206 | 6/1991 | Schield et al. | 52/455 |
| 5,074,087 | 12/1991 | Green | 52/455 X |
| 5,088,250 | 2/1992 | DeLong et al. | 52/204.597 X |
| 5,105,597 | 4/1992 | Wilkening | 52/455 |
| 5,138,811 | 8/1992 | Parrott | 52/204.597 |
| 5,207,044 | 5/1993 | LaSee | 52/208 X |
| 5,249,403 | 10/1993 | Neilly et al. | 52/455 X |
| 5,469,903 | 11/1995 | Stanley | 52/455 X |
| 5,546,714 | 8/1996 | Kenkel | 52/455 X |
| 5,560,168 | 10/1996 | Gagne et al. | 52/455 |
| 5,577,355 | 11/1996 | Leonelli | 52/204.597 X |
| 5,584,154 | 12/1996 | Koepke et al. | 52/455 X |
| 5,628,155 | 5/1997 | Nolte et al. | 52/204.591 X |

*Primary Examiner*—Beth A. Audrey
*Attorney, Agent, or Firm*—Chernoff, Vilhauer, McClung & Stenzel, LLP

[57] ABSTRACT

A door pressed from fiberboard opposing door forms to define elongate depressions of timber-like appearance disposed around the door or parts thereof within an elevated outer periphery portion of the door. Each of the depressed elongate timber-like panels surround a number of elevated door panels that are removed. The facing set of door forms have spacers and edging members, wherein the edges of the door forms from which the elevated panels are removed have plastic edging strips disposed on the opposing edges of each face of the door forms to support glazing therein.

8 Claims, 9 Drawing Sheets

RAISED PANEL DOOR

BACKGROUND OF THE INVENTION

The present invention relates to an improved raised panel door.

Raised panel doors for internal use are currently formed on a very large scale for use as doors to internal rooms of dwelling houses, office suites, wardrobes, and similar internal cupboard arrangements. The doors are normally formed from either medium or high density fibre-board. A large market exists for such doors in view of the high quality which is achievable by producing doors formed from two opposed pressed medium density fibre-board sides or forms, interconnected by spacing members and edge members. The doors can be primed and painted to provide appropriate coloring, wood texture, and shading.

The advantage of pressed doors is that outwardly they appear to have formed elevated panels in accordance with traditional paneled door construction, which are far more time consuming and costly to make.

The market requirements are such that at times it is desirable to have glass panels rather than solid wood panels. The glass panels can either be transparent, translucent, or mirrored. This requirement has previously been achieved after manufacture of the door assembly by cutting out along the elevated edges of the surrounding elevated outer edging "timbers" the relevant depressed elongate timber-like areas of the door and the included elevated panel or panels. Thereafter, in its place, a framework or "cassette" of wood or plastic material is inserted to support glazed panels and to engage within the aperture formed in the prefabricated door.

Typically, the cassette includes the surrounding supports for the glazing panel to be attached, for example, by adherence to the edges of the door from which the recessed elongate parts and elevated panel or panels have been removed. Also glazing-bars may be attached to the glazing and/or disposable above the glazing to simulate smaller glazing pieces or panes. For example, the glazing pieces or panes may provide the appearance of 4, 6, 8, or 12 rectangular pane doors.

While such arrangements enable construction of doors with glazed portions, the arrangement is necessarily such that often the portion that surrounds the glazed panels in particular, but also sometimes the separating plastic glazing bars delineating the individual glazed panels, protrude above the plane of the elevated parts of the door on each side thereof. This protrusion has a disadvantage of not having an aesthetic appearance, and also requires during the manufacture, storage, and distribution of the doors costly additional temporary spacing members to ensure that when stacking glazed doors upon one another no detrimental or damaging contact between parts of the doors occur.

Referring to FIGS. 1 and 2, an example of such a door 10 includes two pressed together fibre-board panels 14*a* and 14*b* to define elevated portions 16 with internal solid supports 18. Recessed portions 22*a*–22*d* provide a timber-like appearance both horizontally and vertically, and define four central elevated portions 20*a*–20*d*, respectively. The four central elevated portions 20*a*–20*d* include respective internal solid supports 24*a*–24*d*. The overall appearance is a panelled door that is producible in different panel types, such as 2, 4, or 6 panels. The recessed portions 22*a*–22*d* preferably have a contoured finish to give the appearance of timber beading holding the elevated portions 20*a*–20*d* in place.

Referring to FIG. 3, the door of FIG. 1 may be cut along the interior edges 27*a*–27*d* of the outer elevated portion 16 in order to remove the recessed portions 22*a*–22*d* and elevated portions 20*a*–20*d*. A glass insert 29 is held in position within each cut away portion by timber or UPVC glazing beads 32 protruding outwardly beyond the elevated portion 16. The glass insert 29 may be 4 mm thick toughened glass. Glazing bars 30 (one shown) of UPVC are adhered to both sides of the glass insert 29 to give the appearance of a multi-panned glass panel.

What is desired, therefore, is a raised panel door that is constructed so that the internal elevated portions are readily removable in such a manner to support inserts therein, such as glass.

SUMMARY OF THE PRESENT INVENTION

The present invention overcomes the aforementioned drawbacks of the prior art by providing, in accordance with one aspect of the present invention, a method of forming a door pressed from fiberboard opposing door forms. The door forms are elevated surrounding the perimeter and include timber-like elongate depressions within the perimeter portions of the door. Within the depressions are disposed elevated panels. Each fiber-board door form is processed to release the elevated panels along the elongate timber-like depressions there-around. The facing two sets of door forms are pressed together with spacers of a solid spacing nature, together with edging spacers. The edges of the door form from which the elevated panels are removed are provided with plastic edging strips on the opposing edges of each side of the door forms for support.

In accordance with another aspect of the present invention, the door is pressed from fiberboard opposing door forms to define elongate depressions of timber-like appearance disposed around the door or parts thereof within an elevated outer periphery portion of the door. Each of the depressed elongate timber-like portions surround a number of elevated door panels that are removed. The facing set of door forms have spacers and edging members, wherein the edges of the door forms from which the elevated panels are removed have plastic edging strips disposed on the opposing edges of each face of the door forms to support glazing therein.

In the preferred embodiment, the upper edge member of the door may be provided with an appropriately dimensioned slot to enable the glazing panel to be inserted therethrough for subsequent engagement with the plastic edging strips provided on the two sides and the base of the edges of the removed elevated panels.

The plastic edging strips may be generally concave, such as U-shaped, strips arranged to fit jointly around the edges of the two half door forms cut edges to support the glazing panel inserted from the upper edge of the door. The strips may include cut edges at the corners thereof to facilitate a push-in fit. Parts of the base of the U-shaped strips may be cutaway, for example, along the upper edge of the glazed panel, to enable insertion of the pane of glass therethrough.

The extrusion of the U-shaped plastic strips may incorporate a coextruded softer plastic portion at the base of the U-shaped member within which the glazing panel at its edges are disposed to provide a softer resilient support. In addition, tongues of softer plastic material may be arranged to protrude from the sidewalls of the U-shaped member to provide additionally resilient support for both sides of the glazing panel.

In an alternative arrangement, the plastic edging strips may include separate resilient elongate plastic glazing clips, each of which is attached to opposing edges of the depressed portions of the panel to be glazed. These resilient clips may incorporate inwardly extending fingers to grip firmly, but resiliently, the glazing panel to be inserted, and configured to cover the edge of each opposed fiberboard panel so as to engage firmly around the edge and within the wall of each form.

An appropriate mouth recession may be provided along the length of each of the clips (disposed in use within each form) to receive the edges of a locating cross-piece strip down the sides and along the lower edge of the opening within the door on opposite parts of the door members. This limits the movement of the glass panel vertically and horizontally when inserted from an overhead opening slot in the upper edge of the door.

While the plastic elongate glazing clips are configured to provide movement of the glass panel therein, subject to the restraining effect of the inwardly protruding fingers and the cross-piece strip connected therebetween, the dimensions of the glazing bars may be such as to conform tightly and accurately to the glazed opening movement of the glass.

In another alternative, the clips may differ slightly, with one clip having a recess along its length and the other clip (where movement within the door is to be prevented) incorporating a matching protrusion. This replaces the need for the cross-piece strip.

It will be appreciated that the glass panel may have applied to it the usual plastic glazing bars secured to the surface of the glass on each side to provide separation of the glazing into a plurality of separate small rectangular or other shaped portions. Where glazing clips are used, the glazing may be either carried out prior to actual formation of the door or at the same time with an appropriate jig.

The edge strips for each glass panel may be separate for each edge of the aperture or a single strip, both of which are appropriately notched for the four corners of the aperture.

The door may incorporate two fiberboard door forms with the necessary solid and card separation. Appropriate neck formations around the inner edges of the depressed elongate portions surrounding the raised door panels are provided, suitable to be "punched out" during the formation of the door. The door may be provided with glazed panel edging strips and glazing therein at levels below the elevated edge portions of the door.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENT

Figure 3:
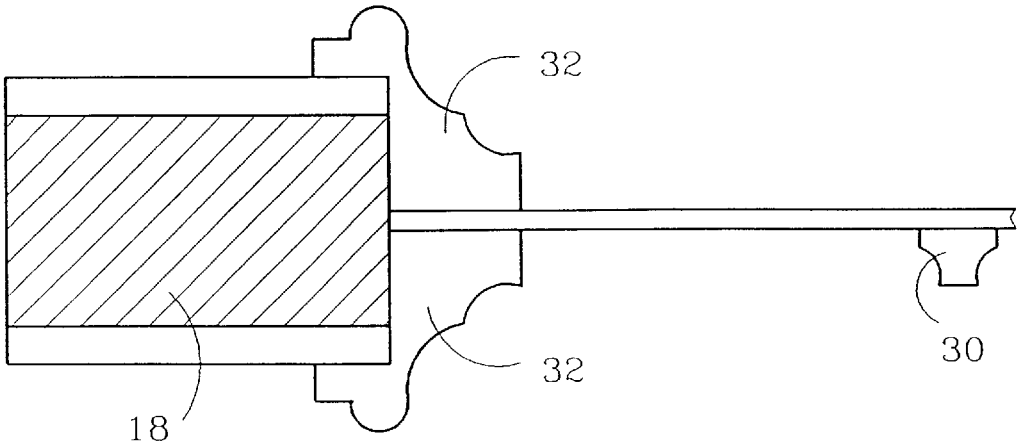
FIG. 3 Prior Art
FIG. 3 is a breakaway sectional view of a form of glazing applied to the door of FIGS. 1 and 2.
Figure 10:
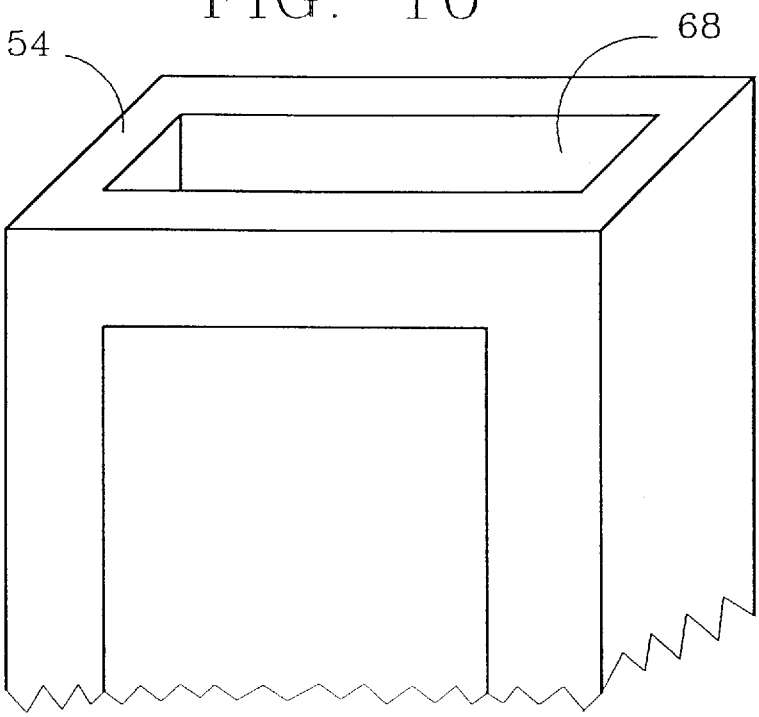
FIG. 10 is a breakaway pictorial view of the upper portion of a door of the present invention detailing a slot.

The prior art door described above may be modified by removing at least a portion of the recessed portions 22*a*–22*d* and elevated portions 20*a*–20*d*, as described in relation to FIG. 3. The glass 29 is inserted through a slot 68 at the upper end of the door (FIG. 10). A plurality of glazing bars 30 are adhesively attached to both sides of the glass 29 to separate the glazing into a plurality of glazed portions 44.

Figure 1:
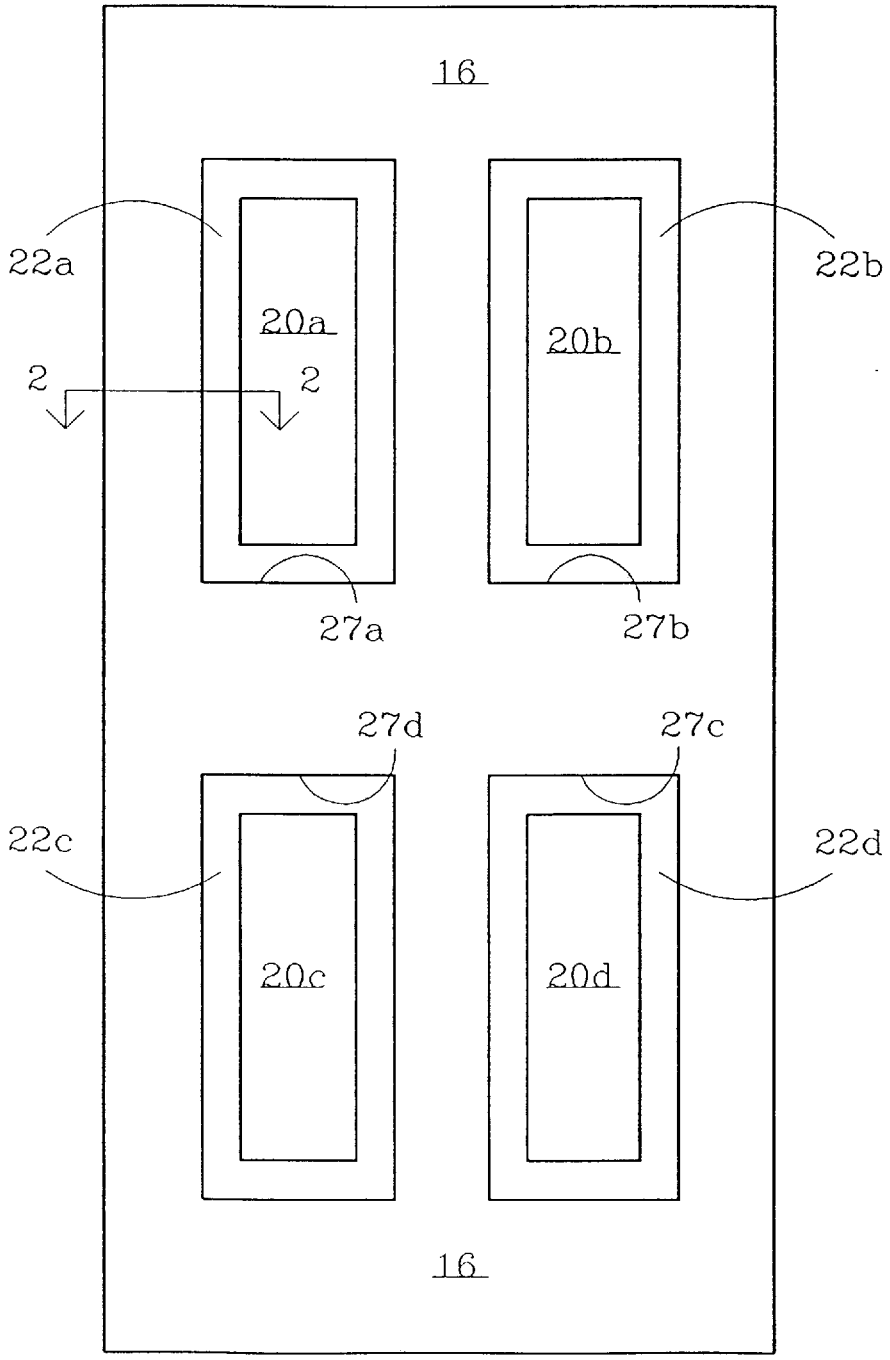
FIG. 1 PRIOR ART
FIG. 1 is a schematic illustration of a known raised panel door.
Figure 2:
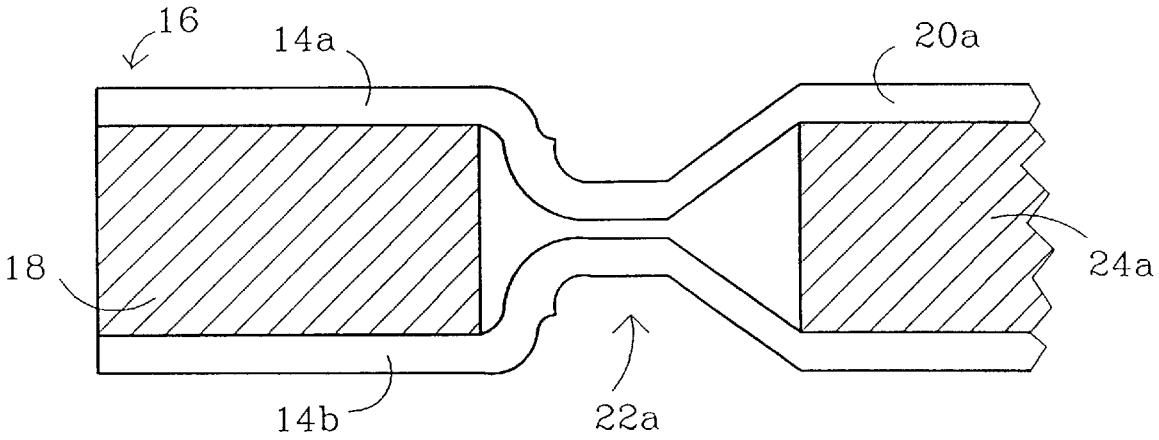
FIG.2 Prior Art
FIG. 2 is a breakaway sectional view taken along line 2—2 of F 1.
Figure 4:
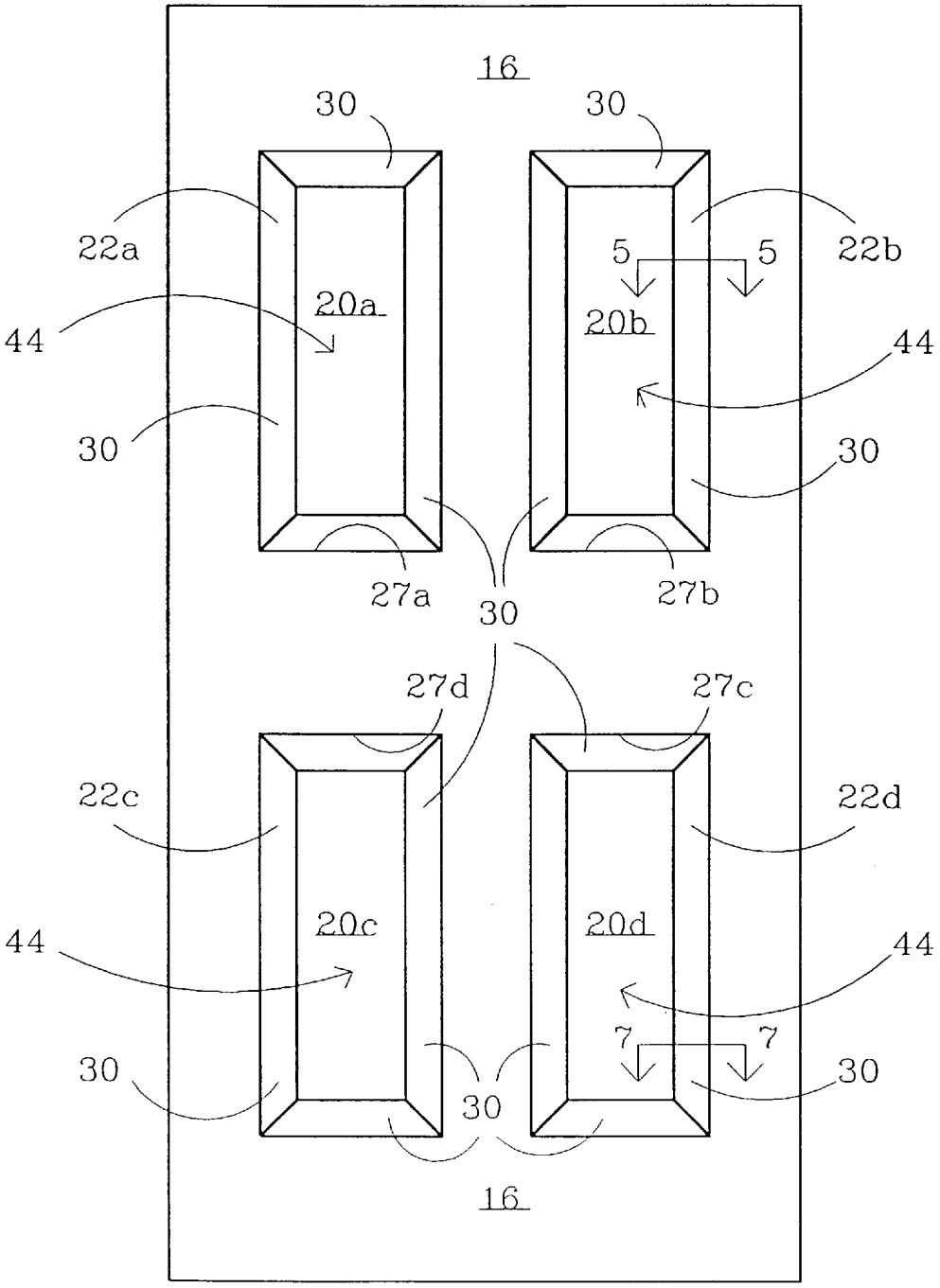
FIG. 4 is a schematic illustration of a glazed door suitable for use with the present invention.
Figure 5:
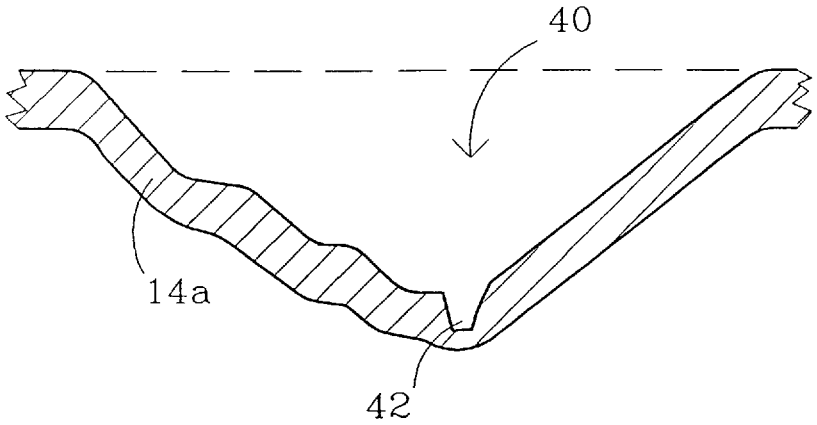
FIG. 5 is a sectional view taken along line 5—5 of FIG. 4 showing the shape of a portion of the door and a notch.

Referring to FIGS. 4 and 5, a door, such as the one shown in FIGS. 1 and 2, is pressed together with curvy surfaced recessed portions 40 between the elevated portions 16 and 20*a*–20*d*. Each of the recessed portions 40 defines a neck 42 at its lowest portion. The door preferably is constructed from medium density fiberboard. After pressing the door together, the neck 42 can be "punched" from the panels 14*a* and 14*b* to permit removal of respective inner portions. In other words, the notch 42 provides a weakened portion around the circumference of the respective portion 20*a*–20*d* that is easily broken apart from the remainder of the door so that the broken away portions 20*a*–20*d* can be readily removed. Other types of weakened portions may likewise be used.

Figure 7:
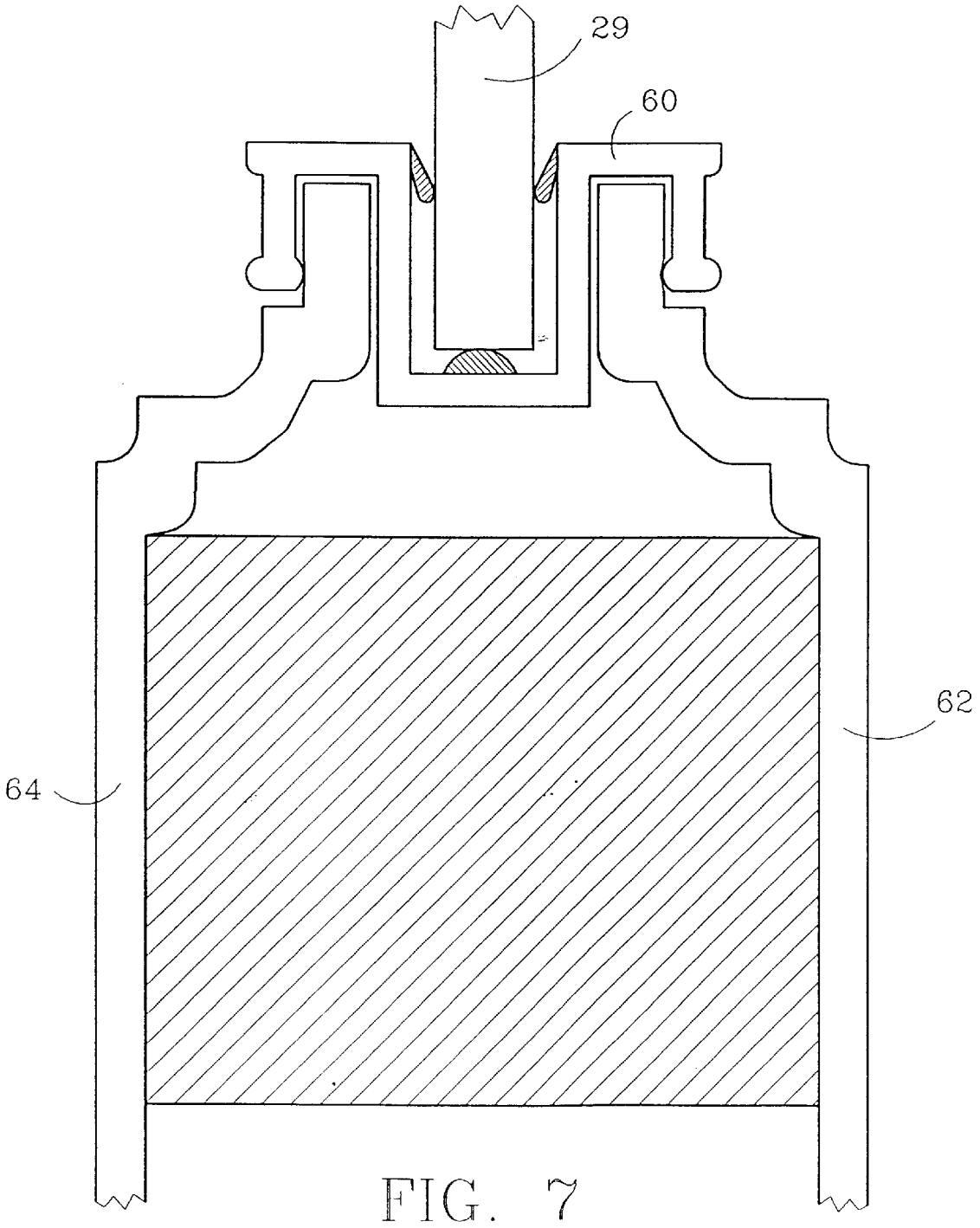
FIG. 7 is a sectional view taken along line 7—7 of FIG. 4 detailing the placement of the edging strip shown in FIG. 6.
Figure 9:
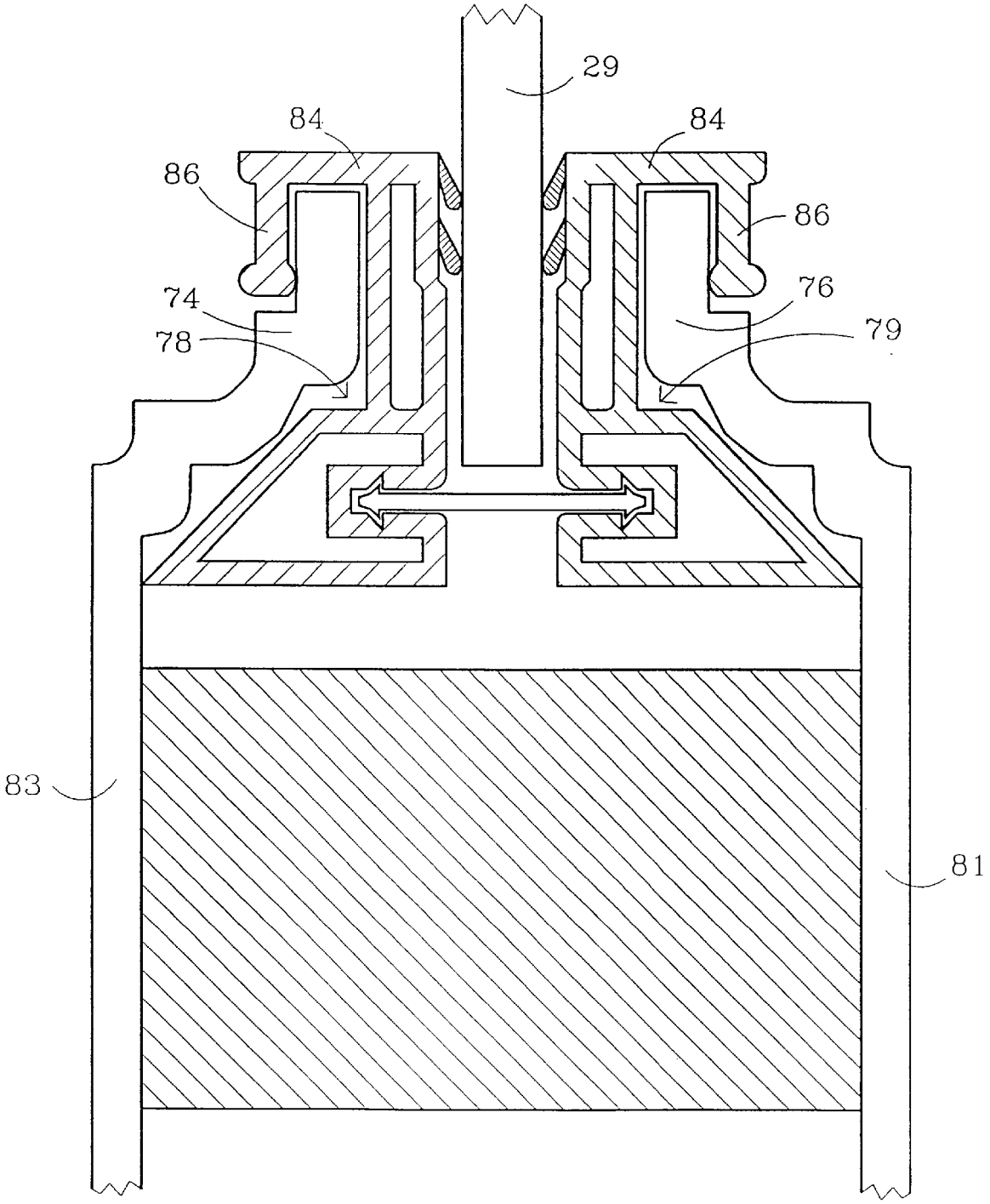
FIG. 9 is a sectional view of a door detailing the placement of the alternative plastic edging strip or clip shown in FIG. 8.

The notch 42 enables the production from a pair of forms, of the general configuration shown in FIG. 2, to enable the provision of a glazed panel 29 as illustrated, for example, in FIGS. 7 and 9. The glazed panel may also be a wood panel. It will be appreciated that in different embodiments of the invention, only some panels of a door may be removed to leave some solid door panels in the finished door with only some panels of the door replaced by glazing in accordance with the invention.

After removal of the internal panels of the door by breaking the notch 42, the door may then be passed though its necessary forming stages with internal solid supports 18 around the elevated portions 16, and wherever else is required, together with supporting transverse strips of card or corrugated card (not shown) elsewhere in the door.

Figure 6:
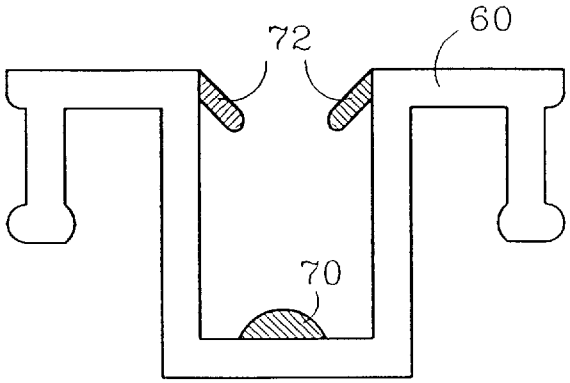
FIG. 6 is a sectional view of one form of resilient plastic glazing edging strip suitable for use with the door of FIG. 4.

Referring to FIG. 10, as part of the forming process the door is provided with edge members 54 adhered to the door. Referring to FIGS. 6 and 7, in one embodiment of the present invention, a resilient plastic strip 60 may be applied around the edges of the two side parts 62, 64 and the lower ledge of the panel door (panels 14*a* and 14*b*). At the upper edge of the opening, the base of the strip is cut away, and appropriately sized glass 29 is inserted from the slot 68 in the top surface edge member 54 of the door such that it engages upon softer resilient plastic material 70 at the base of the lower plastic edging strip 60, and is held by inwardly protruding strips 72 of soft plastic material.

Artificial glazing bars may then be added to the glass panel to provide sub-division of the glass panel into desirable rectangular portions, which firmly locate the glass in place.

Figure 8:
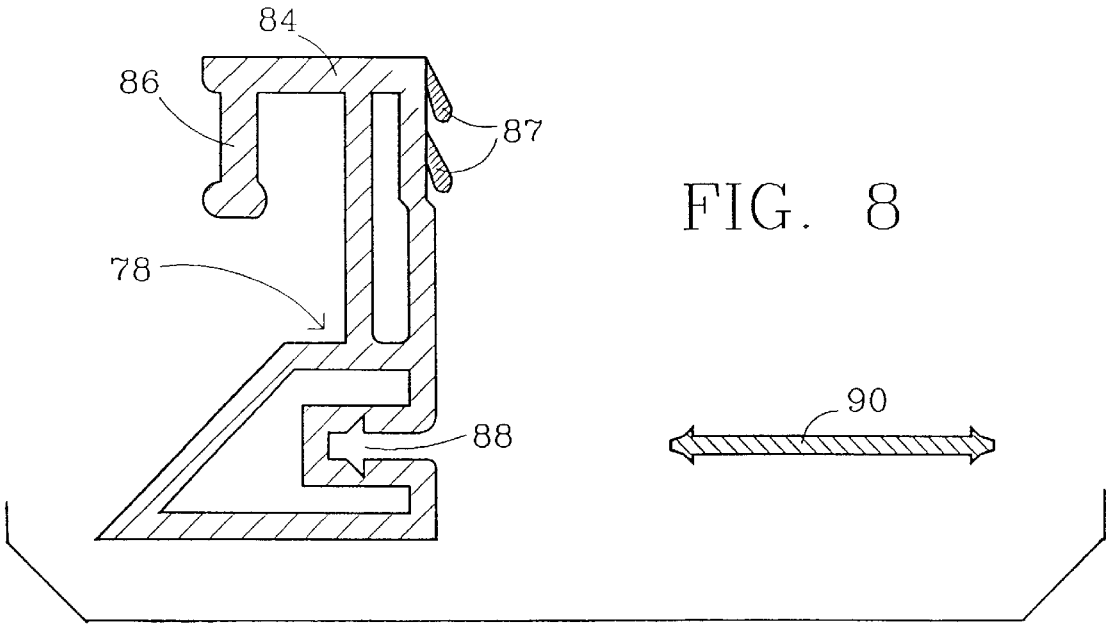
FIG. 8 is a sectional view of an alternative plastic edging strip or clip suitable for use with the door of FIG. 4.

Referring to FIGS. 8 and 9, an alternative arrangement is illustrated that includes separate resilient plastic clips 78 and 79, one being the mirror image of the other when inserted or simply turned 180 degrees. The resilient plastic clips 78 and 79 are located around each of the two edges of the depressed portions 74 and 76 of the door side forms 81, 83, each of these conforming internally to the configuration and dimensions of the relevant door sides as it reduces from the outer extension to the inner depression of the pressed door panel. End portions 84 and clipping portions 86 fit over the edges of the depressed portions 74 and 76 for firm location of the individual strips within their respective door panel portions.

It will be observed that inwardly of the two door sides the strip is provided with two glass engaging inwardly protruding fingers 87 and there is provided an elongate recessed tongue 88 adapted to receive one side of a locating cross-piece strip 90 which is arranged to close the space within which the glazing panel may fit and hold it securely therein.

With the arrangement as shown in FIGS. 8 and 9 it is possible to apply the clips 78 and 79, the cross-piece strip 90, the glass plane 29, and by using appropriate jigging, the glazing bars, all before bonding the door forms together.

Referring to FIG. 9, the glazing panel 29 fits closely within the two resilient plastic clips 78 and 79 being held by the two inwardly extending tongues 88 of each of the clips thereof, and is located to prevent longitudinal movement of the glazing panel 29 further into the body of the door by means of the strip 90 which locates within the elongate tongues 88 of the plastic clips 78 and 79. In case of breakage of the glass it may be removed and a new one provided by the slot 68 in the upper surface of the assembled door (FIG. 10).

Glazing bars, as mentioned above, if not already fitted, can be added to both sides of the glazing panel 29 to subdivide it into appropriately shaped and dimension rectangular glazing portions.

Figure 11:
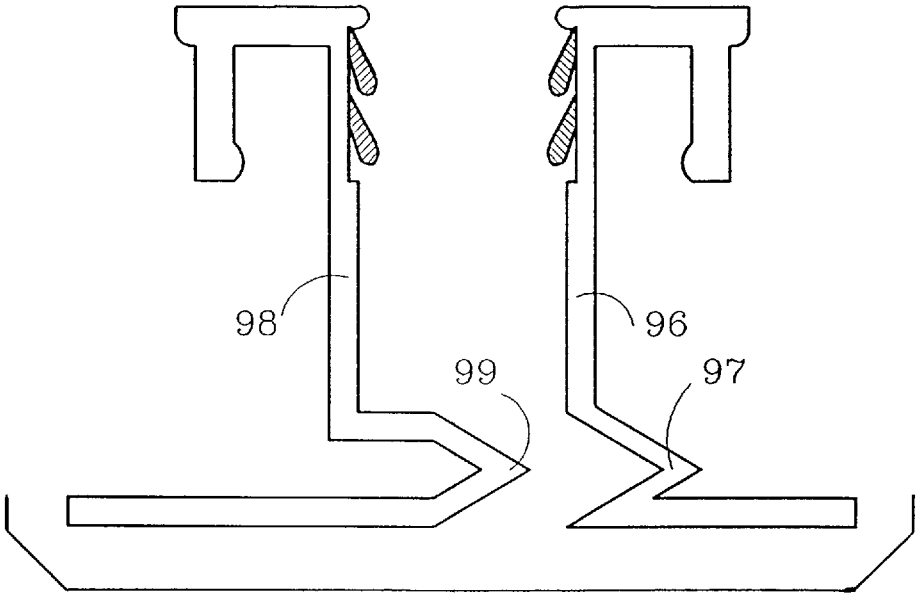
FIG. 11 is a sectional view of a further alternative plastic edging strip or clip suitable for use with the door of FIG. 4.
Figure 12:
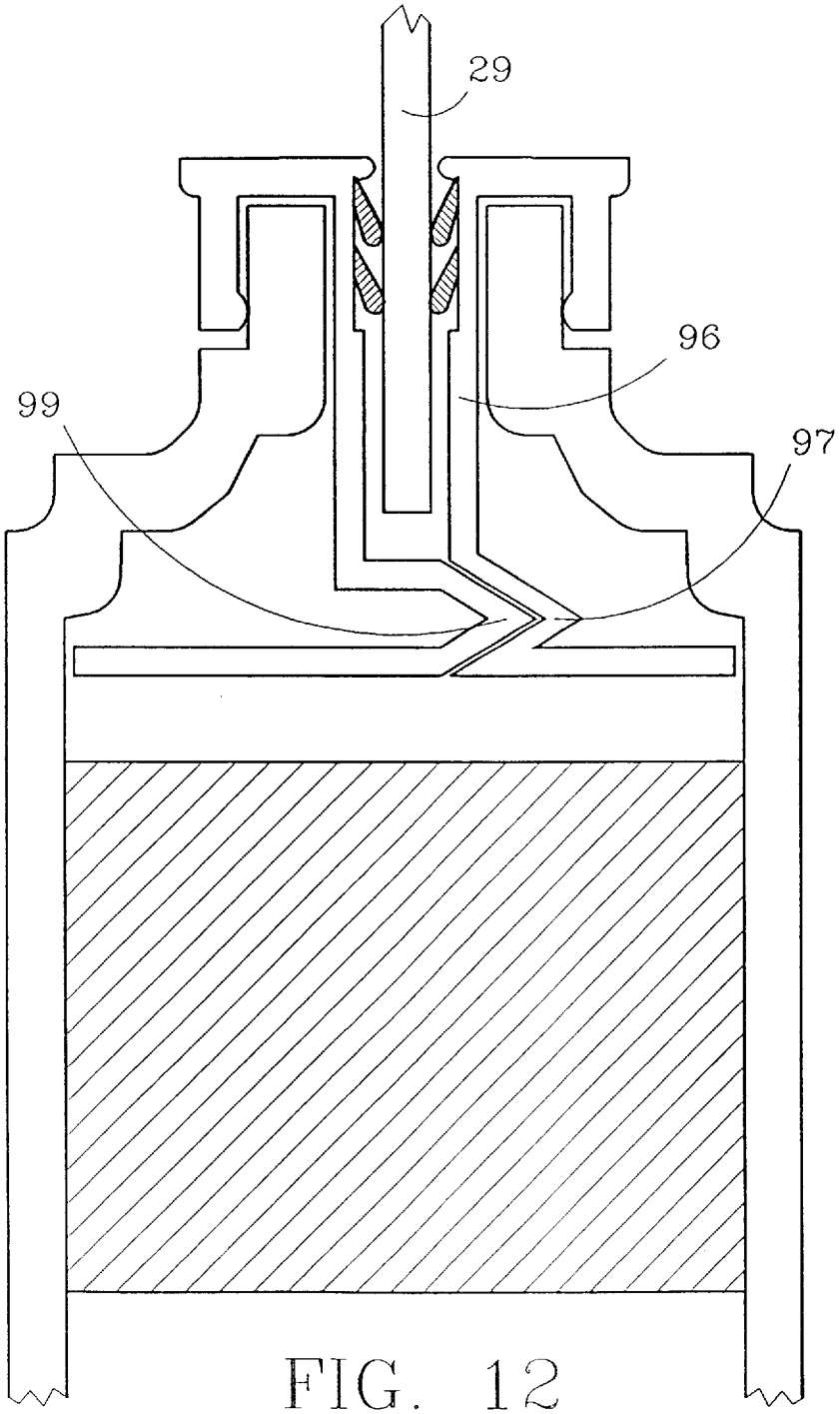
FIG. 12 is a breakaway sectional view of the door of FIG. 4 detailing the placement of the plastic edging strip shown in FIG. 11.

Referring to FIGS. 11 and 12 a further alternative embodiment illustrates glazing strips 96 and 98 similar to those shown in FIGS. 8 and 9, which obviate the need for the cross-piece strip 90.

The lower part of the clips 96 an 98 have an elongate recess 97 and a matching elongate protrusion 99. Referring to FIG. 12, these features prevent movement of the glass 29 within the door. Where such movement is not to be prevented, such as the elongate upper edge of the glazing panel, both sides of the edge may be provided with clips 96.

It will be apparent that the invention has enabled the preparation of a glazed door formed by opposing pressed medium density fiberboard panels which can be prepared for and even provided with glazing during its formation. Complete with the insertion of edge supporting resilient plastic strips thereof and a glazing panel which only thereafter requires the addition of glazing bars to separate the panel into the market required rectangular portions considered so appropriate for such glazing doors.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A door comprising:

(a) a pair of opposing panels attached together by spacers interdisposed between an exterior perimeter region of said panels in order to maintain said exterior perimeter region of said panels at a predetermined distance apart;

(b) at least one of said opposing panels defines an elongate depression, the distance between said panels in said elongate depression being less than said predetermined distance;

(c) said elongate depression defines an enclosed region of said panels within said exterior perimeter region of said panels;

(d) an elongate weakening notch formed into said at least one of said opposing panels in said elongate depression and being suitable for breaking away and removing said enclosed region of said panels; and (e) an elongate strip suitable for engagement with said elongate depression, with said enclosed region of said panels removed, to secure an insert within said enclosed region.

2. The door of claim 1 wherein said opposing panels have a rectangular shaped outer periphery.

3. The door of claim 1 wherein said elongate depression has a curvy surfaced contour.

4. The door of claim 1 further comprising a plurality of elongate depressions defining a plurality of enclosed regions within said panels wherein each of said plurality of elongate depressions is separate from one another.

5. The door of claim 1 further comprising:

(a) a top surface of said door defined by said spacers; and (b) an elongate slot defined in said top surface suitable for said insert to be inserted therethrough.

6. The door of claim 1 wherein said strip is generally U-shaped with both, a central portion sized to be inserted between a respective pair of edges of said panels, and a pair of opposing exterior portions sized to engage outer opposing sides of said panels.

7. The door of claim 1 wherein said strip comprises a first piece and a second piece, said first piece has a first portion sized to be inserted between a respective pair of opposing edges of said panels and a second exterior portion sized to engage an outer side of one of said panels, said second piece has a first interior portion sized to be inserted between said respective pair of edges of said panels and a second exterior portion sized to engage an outer side of the other one of said one of said panels, said first piece and said second piece adapted to be simultaneously inserted along the same length of said respective pair of edges of said panels.

8. A method of constructing a door comprising the steps of:

(a) attaching a pair of opposing panels together by at least one spacer interdisposed between said panels along a major portion of an exterior perimeter region of said panels in order to maintain said exterior perimeter region of said panels at a predetermined distance apart;

(b) forming an elongate depression in at least one of said opposing panels so that the distance between said panels in said elongate depression is less than said predetermined distance, said depression defining a weakened portion therein;

(c) said depression defining an enclosed region of said panels within said exterior perimeter region of said panels;

(d) breaking away said enclosed region along said weakened portion and removing said enclosed region from said panels; and (e) engaging an elongate strip with said panels where said enclosed region was removed, and securing an insert within said enclosed region.

* * * * *